United States Patent [19]

Malbec

[11] 4,181,476

[45] Jan. 1, 1980

[54] PERISTALTIC PUMP AND A TUBE FOR SAID PUMP

[76] Inventor: Edouard Malbec, Logis de Chalonne, Le Gond Pontouvre, France, 16160

[21] Appl. No.: 834,544

[22] Filed: Sep. 19, 1977

[51] Int. Cl.[2] ..... F04B 43/12; F04B 45/08

[52] U.S. Cl. ..... 417/477

[58] Field of Search ..... 417/475, 476, 477

[56] References Cited

U.S. PATENT DOCUMENTS

| | | | |
|---|---|---|---|
| 2,899,907 | 8/1959 | Becher | 417/477 |
| 3,674,383 | 7/1972 | Iles | 417/476 |
| 3,740,173 | 6/1973 | Natelson | 417/477 X |
| 3,816,035 | 6/1974 | Malbec | 417/477 |

FOREIGN PATENT DOCUMENTS

| | | | |
|---|---|---|---|
| 2276483 | 1/1976 | France | 417/477 |

*Primary Examiner*—Richard E. Gluck
*Attorney, Agent, or Firm*—Fleit & Jacobson

[57] ABSTRACT

The peristaltic pump has a rotor which is placed around a drive shaft and made up of planet-wheels supported by a planet-wheel carrier. The planet-wheels are maintained in contact with the drive shaft by means of a flexible tube forming a pump body which is passed at least once around the planet-wheels and the suction and discharge ends of which are approximately opposite to each other. Each interval between the planet-wheels is fitted with at least one inner rolling support for the tube.

4 Claims, 6 Drawing Figures

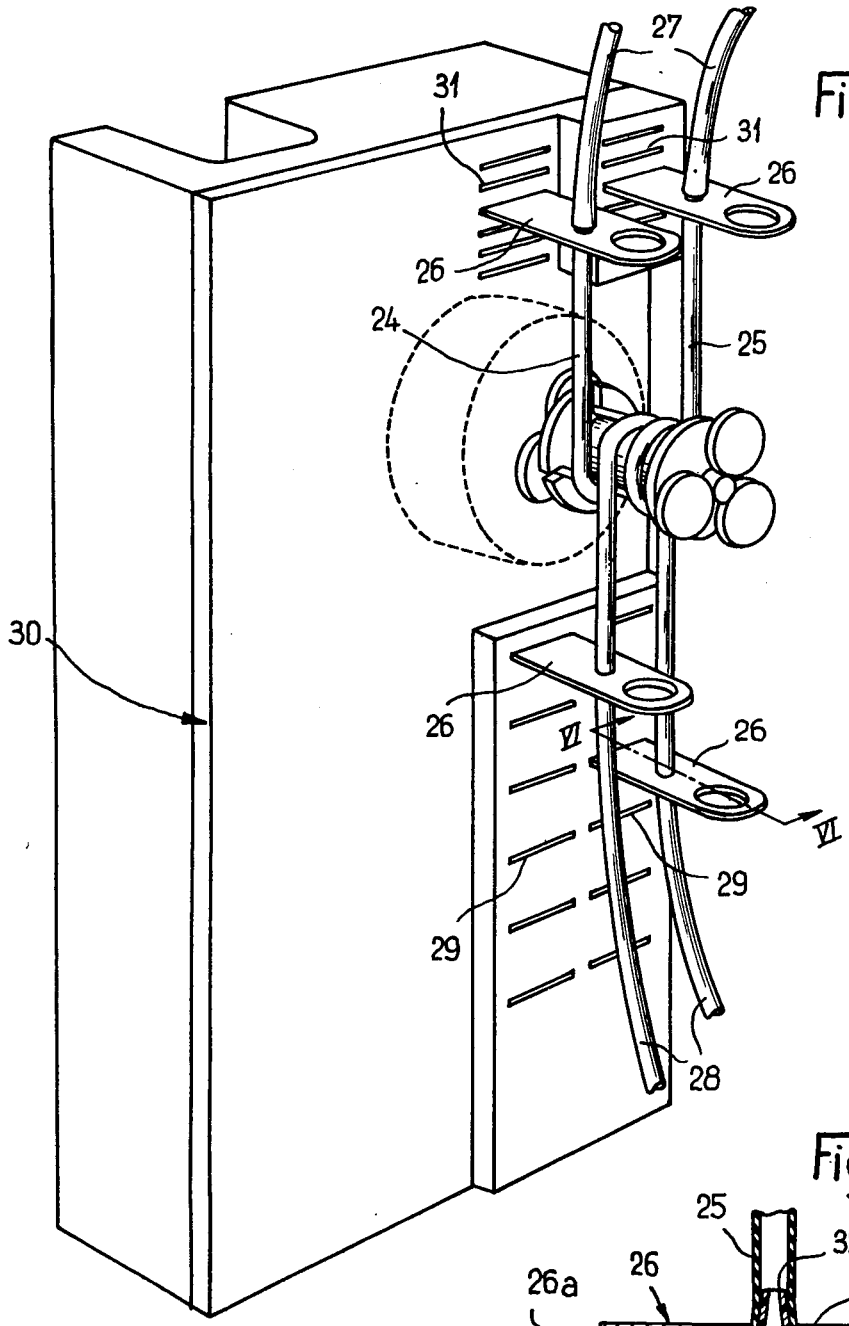
Fig-5
Fig-6
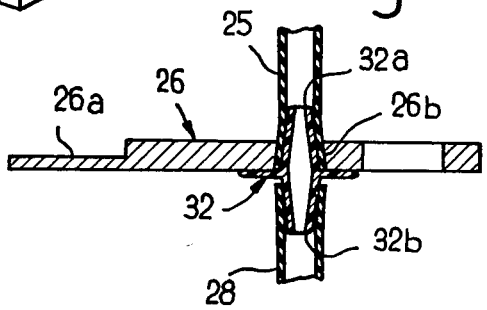

PERISTALTIC PUMP AND A TUBE FOR SAID PUMP

French Pat. No. 2.276.483 relates primarily to a peristaltic pump provided with a rotor which is placed around a drive shaft, the rotor being composed of planet-wheels which are supported by a planet-wheel carrier. Said planet-wheels are maintained in contact with said shaft by means of a flexible tube forming a pump body which is passed around the planetwheels in at least one complete turn and the suction and discharge ends of which are approximately opposite to each other.

The principal advantage of a pump of this type lies in the fact that it calls for a driving motor of relatively low power for a given operation in comparison with pumps of ordinary types. However, as is generally the case with pumps of conventional design, it gives rise to pulsatory rotation and even to a certain cyclic effect of backflow of the fluid which is pumped between pulses. This may prove undesirable in some areas of use such as laboratory or medico-surgical applications, for example. Although appreciable, the output adjustment carried out on pumps of this type by stretching the tube still remains relatively limited.

The aim of the present invention is to provide an improvement in a pump of the type aforesaid which makes it possible to regularize the operation of the pump to a considerable extent while providing a relatively simple constructional arrangement consisting of a small number of planet-wheels. This improvement also permits a very substantial relative increase in the range of adjustment of the pump output as a function of the degree of stretching of the tube.

To this end, the present invention is distinguished by the fact that a pump of the type hereinabove defined comprises at least one inner rolling support for the tube which is formed within each interval between planet-wheels.

Each rolling support can be constituted by a roller which is freely mounted for rotation on the planet-wheel carrier aforesaid or, better still, the complete assembly of rolling supports can be constituted by a ring which is freely mounted internally of the planet-wheels.

By virtue of these design solutions, the desired result can advantageously be achieved in the case of a pump having three or four planet-wheels, for example. Another advantageous feature of a pump structure of this type which is also worthy of note lies in the fact that the relative increase in the tube perimeter which is achieved by means of the rolling supports has the effect of producing an increase in the rotor speed reduction ratio.

Furthermore, by having recourse to a design consisting of planet-wheels of the double type with a central shaft of small diameter over which the tube passes, it will be apparent that the central shafts and rolling supports aforesaid can advantageously be given reverse frusto-conical shapes. This makes it possible to achieve good and efficient operation as well as continuous regulation of the pump output as a function of the axial positioning of the tube on the rotor. This mode of regulation can also be combined with the regulating effect obtained by mounting the tubes in such a manner as to permit variation of the tension applied to these latter.

A number of forms of construction of peristaltic pumps in accordance with the invention will in any case be described hereinafter by way of example, reference being made to the accompanying drawings in which:

FIG. 5 is a view in perspective showing a pump having two tubes and adjustable output;

FIG. 6 is a detail view in cross-section showing a tube-anchoring element and taken along line VI—VI of FIG. 5.

Figure 1:
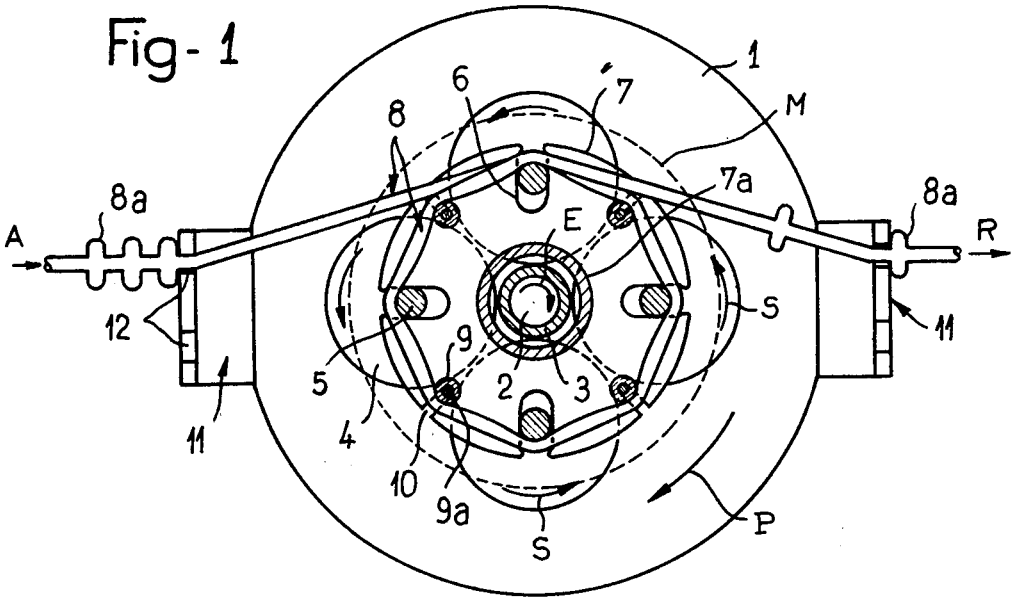
FIG. 1 is a front view of a peristaltic pump with a transverse cross-section of the rotor.

The pump shown in FIG. 1 comprises an electric motor M fixed on a base-plate 1 which forms a pump support frame; the output shaft of said motor is shown at 2 and a drive shaft 3 is mounted on said output shaft in rigidly fixed relation thereto.

There is placed around said shaft 3 a rotor composed of planet-wheels 4 which are double planet-wheels coupled together by means of a shaft 5. These shafts are mounted in corresponding radial recesses 6 formed in two flange-plates 7 of a planet-wheel carrier, said flange-plates being coupled together by means of a hub *7a* which freely surrounds the drive shaft 3.

An inner rolling support for a flexible tube 8 which forms a pump body is arranged within each interval between planet-wheels. Said flexible tube is mounted in elastic tension around the shafts 5 of the planet-wheels and also around said rolling supports. These latter are arranged in spaced relation approximately on the same circumference as that described by the shafts 5 during operation and are constituted by rollers 9 which are mounted to rotate freely between the flange-plates of the planet-wheel carrier, in this case by engagement of end-pins *9a* of smaller diameter than that of the roller in corresponding radial recesses 10 formed in the flange-plates 7. Said flange-plates can be formed of flexible or semi-rigid plastic material and the recesses 6 and 10 can be provided at their inlets with small projections as shown in the drawing. Said projections are intended to ensure that the corresponding shafts which are forcibly engaged in the recesses are retained in these latter and that, when the tube 8 is removed or replaced, the shafts 5 and rollers 9 remain securely coupled to the planet-wheel carrier.

In accordance with a simplified form of construction, the hub *7a* which serves to couple the flange-plates together can be dispensed with. Thus the shafts 5 and rollers 9 themselves form spacer members for axial positioning of the flange-plates 7 on each side of these latter.

Another alternative form of construction which eliminates the hub *7a* consists in assembling the flange-plates by means of spacer members constituting the pins of the rollers. In this case, said rollers are formed by tubular elements which are freely engaged about said spacer pins prior to assembly with the flange-plates.

The tube 8 passes once around the shafts 5 of the planet-wheels and the rollers 9 and is anchored in supports 11 by means of external projections *8a* formed at the ends of said tube. The supports 11 aforesaid are rigidly fixed to the base-plate 1 and provided with recesses 12 for receiving the tube. Said supports 11 are diametrically opposite to the axis of the rotor, with the result that the ends of the tube 8 are also in approximately opposite relation and that balancing of lateral forces on the drive shaft is ensured.

In respect of one direction of rotation of the drive shaft 3 indicated by the arrow E, the planet-wheels 4 are driven in rotation by frictional contact in the direction of the arrows S and the planet-wheel shafts 5 roll in contact with the tube 8 on which they are driven in the direction of the arrow P, thus producing suction at A and discharge at R at the tube ends. Corresponding pipes can be connected to said tube ends by fitting together or by any other suitable method.

Figure 2:
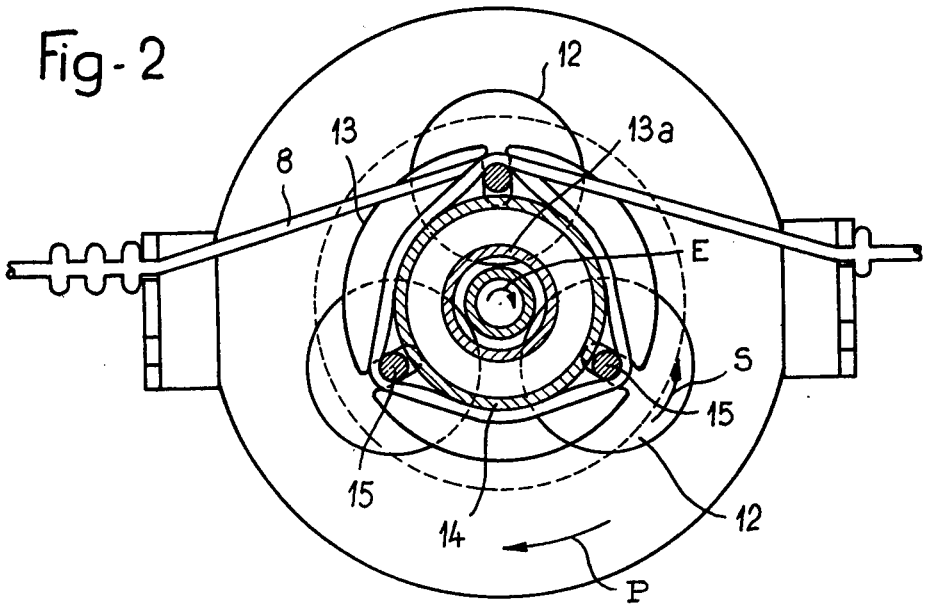
FIG. 2 is a similar view of another embodiment of a peristaltic pump.

FIG. 2 illustrates one economical form of construction of a pump comprising three planet-wheels and intermediate rolling supports between planet-wheels.

As in the previous embodiment, three double planet-wheels 12 are mounted within the radial recesses of two flange-plates 13 which are joined together by means of a hub 13*a*. Between said flange-plates 13 is freely mounted a ring 14 having an external diameter such as to maintain a small radial clearance with respect to the planet-wheel shafts 15, with the result that the complete assembly of intermediate rolling supports of the tube 8 is provided by said ring 14 as is clearly shown in the drawing.

In both cases, there is a considerable improvement in regularity of operation compared with the result which would otherwise be obtained if the tube were not provided with intermediate rolling supports.

In the case of the directions of rotation indicated in the drawing of FIG. 2, it has been observed during operation that the ring 14 is driven in intermittent motion in the direction opposite to the direction P. This appears to be caused by dissymmetrical elastic friction which is set up as the tube returns in contact with the ring and which appears to contribute to the regularization obtained.

It is possible in both cases to modify the degree of stretching of the tube in order to regulate the output obtained over a wide range of adjustment without impairing the efficiency of operation of the pump. Thus the operating range can be practically multiplied by ten compared with that of a pump which is not provided with the improvement in accordance with the invention. Many combinations of stretching of the tube can conveniently be obtained by means of the end projections 8*a* which are illustrated by way of example.

Figure 3:
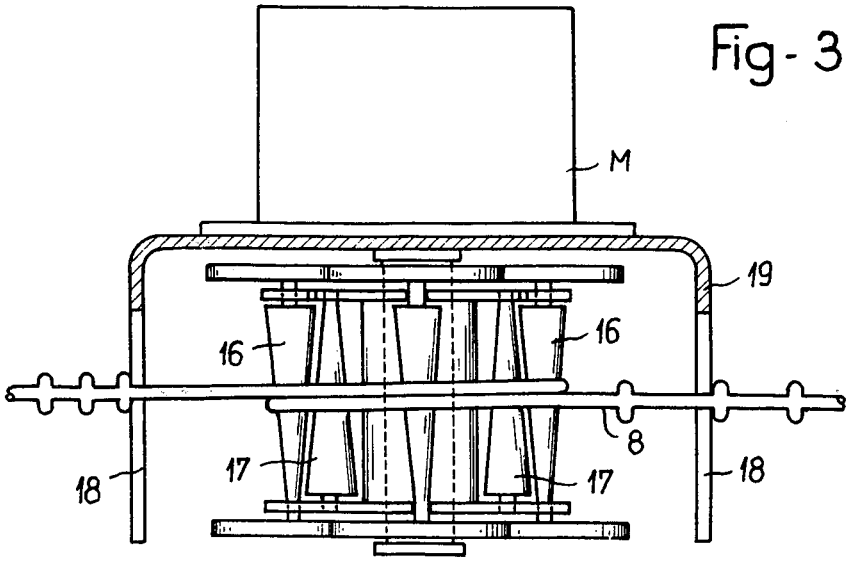
FIG. 3 is a top view of an alternative embodiment of a peristaltic pump of the type shown in FIG. 1.
Figure 4:
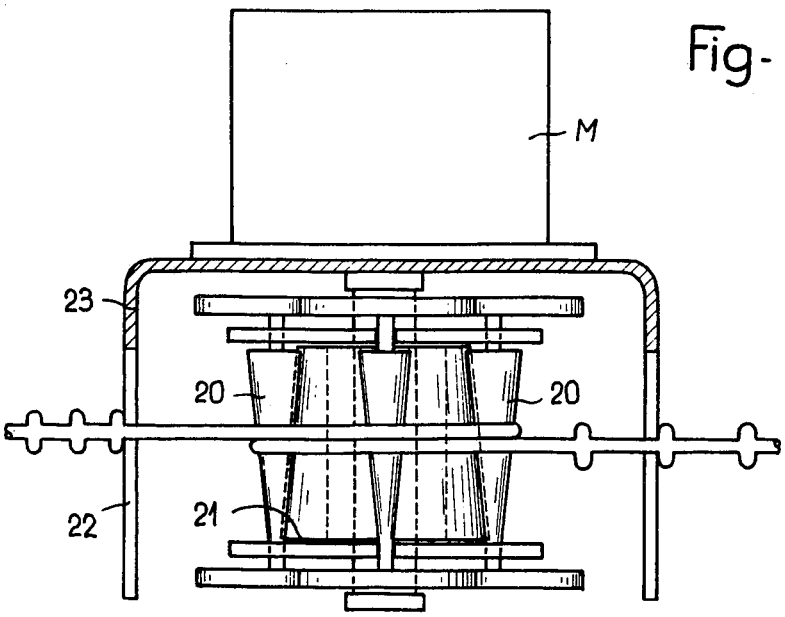
FIG. 4 is a top view of an alternative embodiment of a peristaltic pump of the type shown in FIG. 2.

However, a possibility of continuous adjustment could also be combined with the above-mentioned possibility of non-continuous adjustment by giving the central shafts of the planet-wheels and the rolling supports aforesaid the shape of reverse cone frustums as illustrated in the embodiments of FIGS. 3 and 4.

The form of construction shown in FIG. 3 is that of a pump having four double planet-wheels and is similar to the embodiment of FIG. 1 but differs essentially from this latter in that the central shafts 16 of the planet-wheels have a frusto-conical shape as illustrated and that the rollers 17 which serve as intermediate supports for the tube 8 have an identical but oppositely-directed frusto-conical configuration. The tube 8 can be positioned at will from one end of the shafts 16 and rollers 17 to the other by displacing the tube ends within slots 18 of corresponding depth formed in the frame 19 which can constitute a casing around the rotor.

Thus, irrespective of its axial position, the winding perimeter of the tube 8 on the rotor and therefore its elastic tension are practically not subject to variation. However, the rate of wire-drawing of the tube 8 and therefore the pump output vary as a function of the mean diameter of the frusto-conical portions of the central planet-wheel shafts 16 which cooperate with the tube.

The embodiment shown in FIG. 4 corresponds to a pump having three double planet-wheels and is similar to that of FIG. 2 but differs essentially from this latter in the frusto-conical configuration given to the central shafts 20 of the planet-wheels as shown in the figure and in the fact that the frusto-conical configuration of the inner bearing ring 21 has the same angle at the vertex but is placed in the opposite direction. The tube 8 can be positioned at will from one end to the other of the shafts 20 and the ring 21 by displacing the tube ends within slots 22 of corresponding depth which are formed axially in a casing 23.

Thus, irrespective of its axial position, the winding perimeter of the tube 8 and therefore its elastic tension will vary to only a slight extent whilst the rate of wire-drawing of the tube 8 and therefore the pump output will vary as a function of the mean diameter of the frusto-conical portions of the central planet-wheel shafts 20 which cooperate with the tube.

As can readily be understood, it is also possible to contemplate stepped frusto-conical shapes if a variation in steps rather than a continuous variation were to prove desirable.

FIG. 5 illustrates an embodiment of a pump having two tubes 24, 25 forming two independent pump bodies which are in this case wound in reverse helices around a single rotor of the type shown in FIG. 2 in order to balance the residual tilting couples exerted by each tube on the rotor shaft as a result of the axial displacement produced by the actual winding of each tube on the rotor. This figure also illustrates one mode of tension adjustment of each tube for obtaining an adjustable output of each pump. In this mode of adjustment, each end of the pump body tube is secured to a setting plate 26 with which is associated an element designed to provide a connection with the pipe 27 or 28 for suction or discharge of the pumped liquid.

These two setting plates 26 for the end of each tube cooperate by engagement in one case with successively disposed setting slits 29 formed in a casing 30 in which is fixed the driving motor of the pump input shaft and in the other case with setting slits 31 which are also formed in the casing 30 but disposed successively so as to cover a range of adjustments which is a subdivision of the range covered by the interval between the slits 29.

In the example of construction of the setting plate 26 given in FIG. 6, this latter shows a tongue 26*a* for insertion into the casing and an orifice 26*b* so arranged as to form a collar for clamping the pump body tube in an end piece 32*a* of a flanged double connector 32 provided with a symmetrical end-piece 32*b* on which the suction pipe or the corresponding discharge pipe is intended to be fixed.

It is readily apparent that further alternative modes of arrangement and construction can be devised while remaining within the scope and the spirit of the invention.

I claim:

1. A peristaltic pump comprising a drive shaft, a rotor around said shaft including planet-wheels and a planet wheel carrier, each one of said planet-wheels comprising two wheels and a central shaft connecting the latter and being of less diameter than said wheels, said planet-wheel carrier including two axially spaced flanges having radial recesses wherein said central shafts are respectively mounted with radial freedom, a flexible tube forming a pump body being passed around said central shafts of the planet wheels in at least one complete turn and having suction and discharge ends approximately opposite to each other, said flexible tube maintaining said wheels in contact with said drive shaft, and a ring being freely mounted internally of said central shafts of the planet-wheels and between said flanges of the planet-wheel carrier, said ring forming a rolling support for the flexible tube within each interval between the central shafts of said planet-wheels.

2. A peristaltic pump as claimed in claim 1, wherein said central shafts of the planet-wheels have a frusto-conical shape and said ring has a frusto-conical shape in reverse relation to those of said central shafts.

3. A peristaltic pump as claimed in claim 1, further comprising means for adjustably stretching said flexible tube.

4. A peristaltic pump as claimed in claim 3, wherein said means for adjustably stretching includes a plurality of external projections formed in one end of said flexible tube, and a support provided with a recess for receiving a selected one of said projections mounted adjacent said one end of said flexible tube.

* * * * *